US008091176B2

(12) United States Patent
Salice

(10) Patent No.: US 8,091,176 B2
(45) Date of Patent: Jan. 10, 2012

(54) FURNITURE HINGE DECELERATION DEVICE AND FURNITURE HINGE HAVING SAID DECELERATION DEVICE

(76) Inventor: Luciano Salice, Carimate (IT)

( * ) Notice: Subject to any disclaimer, the term of this patent is extended or adjusted under 35 U.S.C. 154(b) by 62 days.

(21) Appl. No.: 12/521,978

(22) PCT Filed: Sep. 18, 2008

(86) PCT No.: PCT/EP2008/007826

§ 371 (c)(1),
(2), (4) Date: Jul. 1, 2009

(87) PCT Pub. No.: WO2009/059662

PCT Pub. Date: May 14, 2009

(65) Prior Publication Data

US 2010/0205775 A1 Aug. 19, 2010

(30) Foreign Application Priority Data

Nov. 9, 2007 (IT) ..... MI2007A2146

(51) Int. Cl.
*E05F 5/02* (2006.01)

(52) U.S. Cl. ..... 16/82; 16/319; 16/337; 16/286; 16/54; 16/288

(58) Field of Classification Search ..... 16/288, 16/319, 337, 341, 342, 352, 366, 370, 49, 16/50, 51, 54, 55, 82, 286, 287, 56, 294, 16/387, 262, DIG. 21; 188/268, 271, 290, 188/291, 296, 322.5, 281, 285.5, 282.8, 282.9
See application file for complete search history.

(56) References Cited

U.S. PATENT DOCUMENTS 6,859,979 B2 * 3/2005 Egger et al. ..... 16/337
(Continued)

FOREIGN PATENT DOCUMENTS

DE 102 11 294 A1 9/2003
(Continued)

OTHER PUBLICATIONS

Int'l Prelim. Report/Written Opinion of the ISA (Appl. PCT/EP2008/007826), dated May 11, 2010 (6 pgs.).

(Continued)

*Primary Examiner* — Victor Batson
*Assistant Examiner* — Jeffrey O Brien
(74) *Attorney, Agent, or Firm* — Fitch, Even, Tabin & Flannery

(57) ABSTRACT

The device for decelerating at least the closing rotation of a furniture hinge, comprises a container housing a first rotating friction element in contact at a first friction surface with the bottom of the container, a second fixed friction element overlapped to the first rotating friction element with which it is in contact at a second friction surface, and at least a third rotating friction element overlapped to the second fixed friction element with which it is in contact with at least a third friction surface, constraint means between the first friction element and the third friction element, a slider movable along a direction of translation at least during closing rotation and kinematic means for conversion of the translation of the slider into a rotation of the first and third friction element in such a manner as to create a dragging friction at the first, second and third friction surface.

24 Claims, 5 Drawing Sheets

U.S. PATENT DOCUMENTS

| | | | | |
|---|---|---|---|---|
| 7,730,583 | B2 * | 6/2010 | Salice | 16/286 |
| 7,757,348 | B2 * | 7/2010 | Salice | 16/286 |
| 7,810,212 | B2 * | 10/2010 | Salice | 16/286 |
| 7,874,043 | B2 * | 1/2011 | Salice | 16/286 |
| 7,917,995 | B2 * | 4/2011 | Salice | 16/288 |
| 2004/0103499 | A1 | 6/2004 | Egger et al. | |
| 2007/0136990 | A1 | 6/2007 | Salice | |
| 2007/0278725 | A1 | 12/2007 | Miyamoto | |

FOREIGN PATENT DOCUMENTS

| | | | |
|---|---|---|---|
| FR | 1175494 | | 3/1959 |
| WO | 2006/051074 | A1 | 5/2006 |

OTHER PUBLICATIONS

EPO Communication and Annex (Appl. 08802347.8), dated Jan. 1, 2010 (4 pgs.).

Reply to EPO Communication (Appl. 08802347.8), dated Apr. 12, 2010.

EPO Communication and Annex (Appl. 08802347.8), dated Nov. 22, 2010 (4pgs.).

Reply to EPO Communication (Appl. 08802347.8), dated Mar. 8, 2011 (8 pgs.).

* cited by examiner

FURNITURE HINGE DECELERATION DEVICE AND FURNITURE HINGE HAVING SAID DECELERATION DEVICE

CROSS REFERENCE TO RELATED APPLICATIONS

This application is a U.S. national phase application of International Application No. PCT/EP2008/007826, filed Sep. 18, 2008, which claims benefit from Italian Application No. MI2007A002146, filed Nov. 9, 2007, both of which are hereby incorporated herein by reference in their entirety.

The present invention refers to a device for decelerating at least the closing rotation of a furniture hinge and to the furniture hinge having said deceleration device.

Furniture hinges comprising an arm adapted to be fixed to a fixed element of the furniture and a box-shaped element adapted to be fixed to a door of the furniture, a first and second equaliser operatively connecting the box-shaped body and the arm together and defining therewith an articulated quadrilateral have long been available on the market.

Such hinges usually have various types of springs for creating a restoring force opening and/or closing the doors on which they are applied. In such hinges the presence of devices for decelerating the movement of the doors caused by the elastic reaction of such springs is desirable. First and foremost, such deceleration devices are intended to avoid noises due to violent impacts against the body of the furniture during the closure of the doors.

Deceleration devices based on the use of viscous media interposed between the parts in mutual movement are known. Such devices reveal a serious drawback linked to the fact that the efficiency of the deceleration device strongly depends on the ambient temperature in which the viscous medium operates being that its viscosity clearly depends on such temperature.

For example, use of a medium with a high viscosity might be counterproductive if the ambient temperature drops excessively given that it might cause the hinge to block, while the use of a medium with a low viscosity might be inefficient if the ambient temperature rises excessively (for example if a light beam produced by an artificial light present in a room is directed at the hinge in question).

Therefore, the technical task proposed by the present invention is that of providing a furniture hinge deceleration device capable of eliminating the drawbacks revealed by the prior art.

In the scope of this technical task, an object of the invention is that of providing a furniture hinge deceleration device capable of maintaining the ideal efficiency upon the variation of the ambient temperature conditions under which it operates.

Another object of the invention is that of providing a furniture hinge deceleration device which is extremely compact, reliable and inexpensive.

The technical task, as well as these and other objects, according to the present invention are attained by providing a furniture hinge deceleration device according to claim 1. Furthermore, other characteristics according to the present invention are defined in the subsequent claims.

Further characteristics and advantages of the invention shall be clearer from the description of a preferred but not exclusive embodiment of the furniture hinge deceleration device according to the finding, illustrated for indicative and non-limiting purposes in the attached drawings, wherein.

Figure 1:
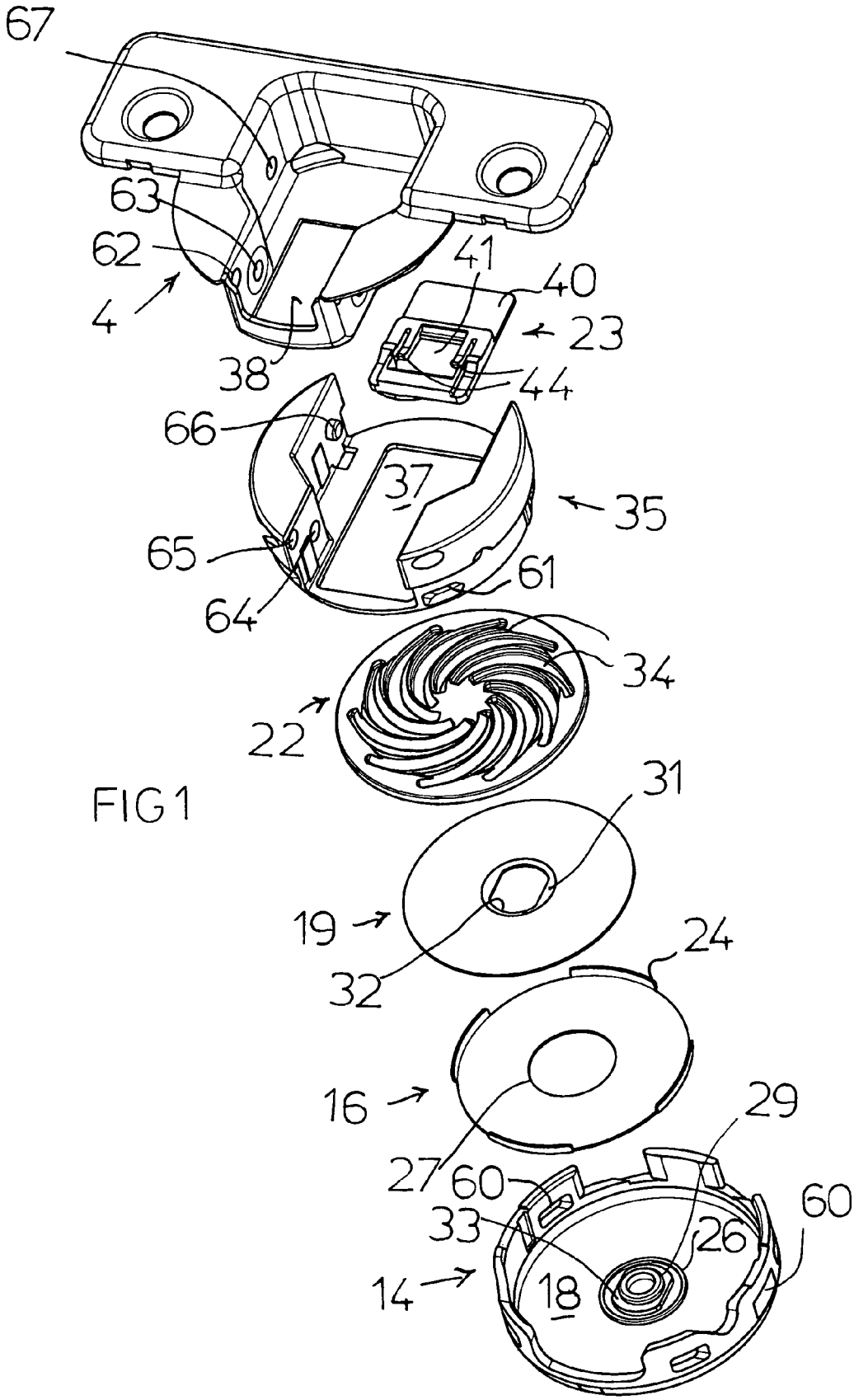
FIG. 1 shows an exploded perspective view of the deceleration device and of the box-shaped body of the furniture hinge according to a preferred embodiment of the invention.
Figure 3:
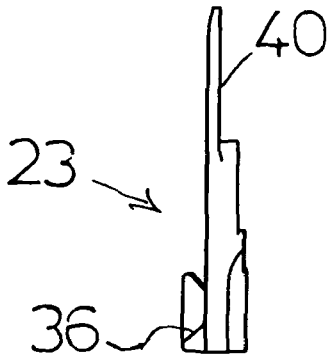
FIG. 3 is a side elevated view of the slider of FIG. 2.
Figure 2:
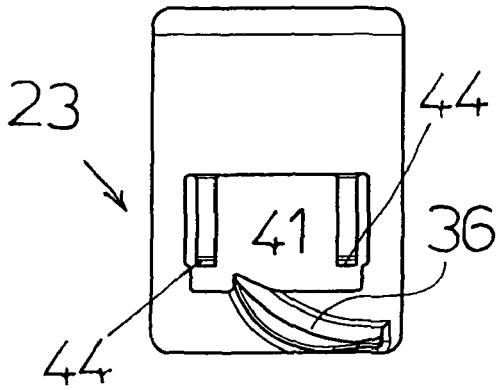
FIG. 2 shows a plan view of the slider of the deceleration device of FIG. 1 from the side facing the third friction disk.
Figure 4:
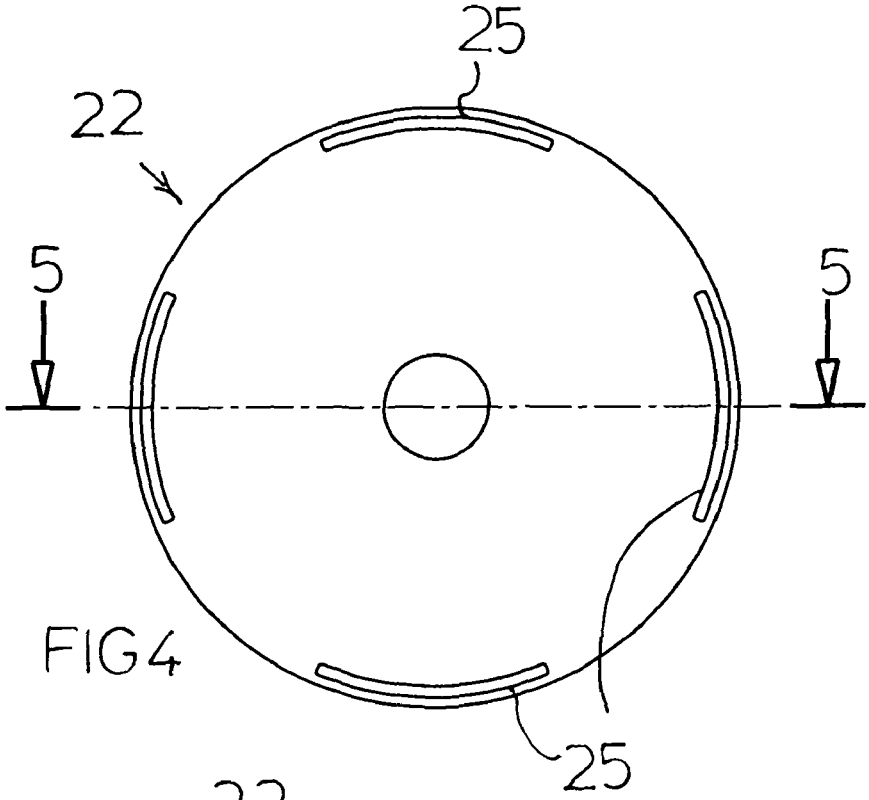
FIG. 4 is a plan view of the third friction disk of FIG. 1 from the side facing the second friction disk.
Figure 5:
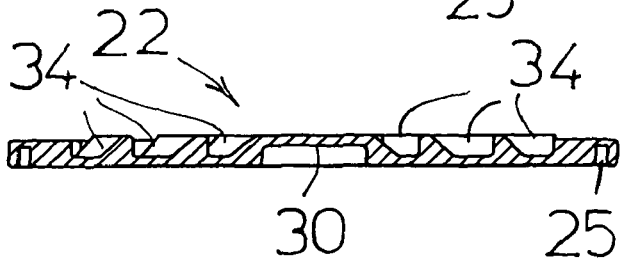
FIG. 5 is a view of the third friction disk sectioned along line 5-5 of FIG. 4.
Figure 6:
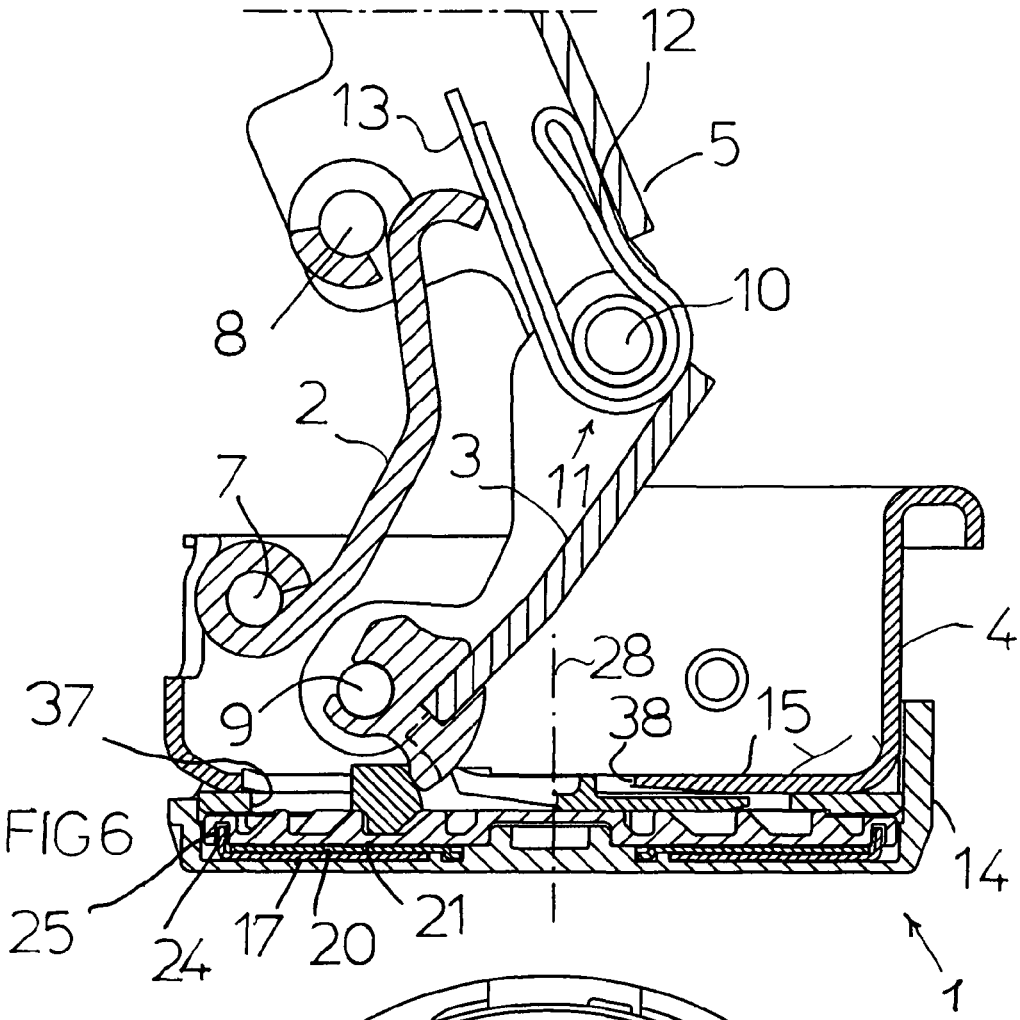
FIG. 6 is a side elevated view, in axial section, of the deceleration device of FIG. 1 applied to the box-shaped body of the furniture hinge before reaching the closure position of the furniture door.
Figure 7:
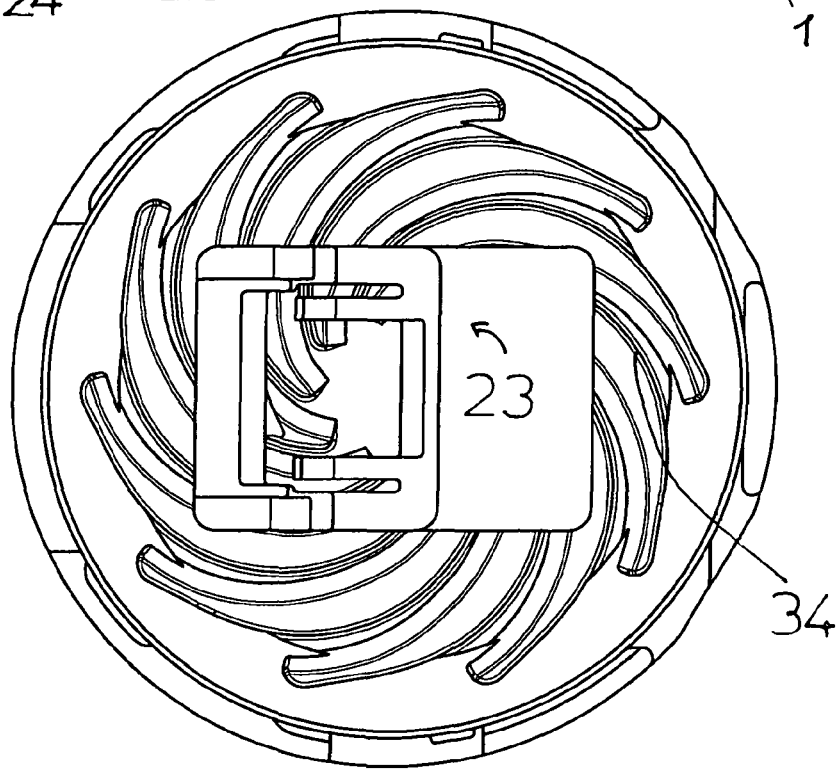
FIG. 7 is a plan view of the deceleration device of FIG. 1 without the cover of the container at the operating position of FIG. 6.
Figure 8:
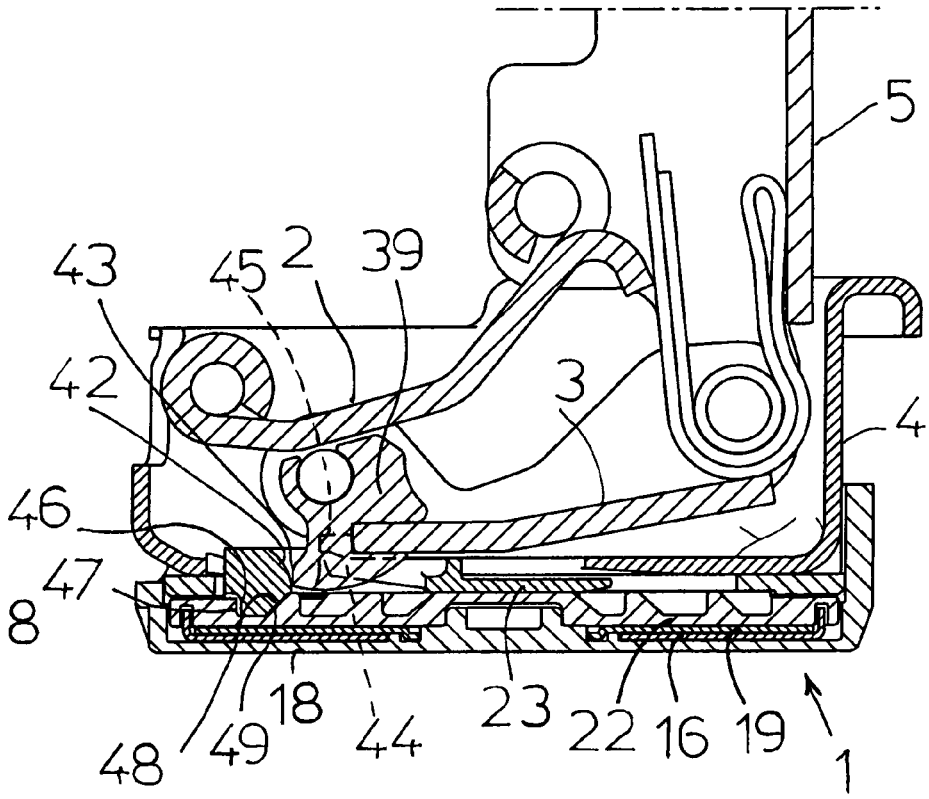
FIG. 8 is a side elevated view, in axial section, of the deceleration device of FIG. 1 applied to the box-shaped body of a furniture hinge at the closure position of the furniture door.
Figure 9:
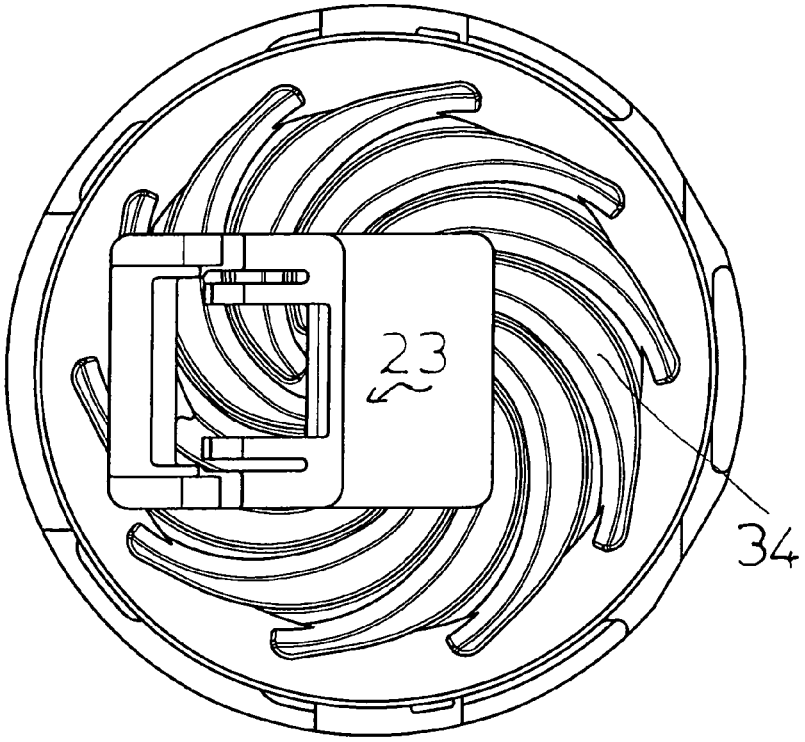
FIG. 9 is a plan view of the deceleration device of FIG. 1 without the cover of the container at the operating position of FIG. 8.

Referring to the abovementioned figures, a furniture hinge deceleration device is shown indicated in its entirety with reference number 1.

The hinge onto which the deceleration device 1 is applied, is of the type comprising a first and a second equaliser 2, 3 which operatively connect a box-shaped body 4 and an arm 5. The box-shaped body 4 is adapted to be fixed onto a furniture door while the arm 5 is adapted to be fixed onto a fixed element (not shown) of the furniture, for example a side of the furniture.

In particular, the first equaliser 2 is pivoted with a pivot 7 to the box-shaped body 4 and with a pivot 8 to the arm 5, while the second equaliser 3 is pivoted with a pivot 9 to the box-shaped body 4 and with a pivot 10 to the arm 5. The hinging pivots 7, 8, 9 and 10 have parallel axis. The structure made up of the box-shaped body 4 and the arm 5 operatively connected by the equalisers 2 and 3 through the pivots 7, 8, 9 and 10 forms an articulated quadrilateral.

Present around the hinging pivot 10 is a spring 11 having a first arm 12 associated with the arm 5 and a second arm 13 associated with the equaliser 2.

The spring 11 during the final closure phase of the door allows creating a restoring force on the door for its spontaneous and accurate closure.

The deceleration device 1 comprises a container 14 to be fixed onto the external side of the bottom 15 of the box-shaped body 4.

The container 14, houses a first rotating friction element 16 in contact at a first friction surface 17 with the bottom 18 of the container 14, a second fixed friction element 19 overlapped to the first friction element with which it is in contact at a second friction surface 20, and a third rotating friction element 22 overlapped to the second friction element 19 with which it is in contact at a third friction surface 21.

The first, second and respectively third friction element 16, 19 and 22 are each made up of at least one circular disk and they are stacked coaxially with their axis which is positioned in coincidence with the axis 28 of the hollow cylindrical body according to which the container 14 is shaped.

Referring to the preferred embodiment illustrated in FIGS. 1-9 the first, second and third friction element 16, 19 and 22 are each made up of a single flat circular disk.

Furthermore, provided in the container 14 are mutual constraint means between the third friction element 22 and the first friction element 16.

The constraint means comprise perimeter flaps 24 of the first friction element 16 engaged in perimeter slots 25, of mating shape, of the third friction element 22.

Obviously, it is possible to have the flaps on the third friction element 16 and the slots on the first friction element 22 in an identical manner.

The flaps 24 extend in a transverse manner from the perimeter edge of the first friction element 16 and they are inserted only partially into the slots 25 in such a manner to leave the first and the third friction element 16 and 22 separated by a distance substantially equivalent to the thickness of the second friction element 19 interposed between them.

The first friction element 16 and the third friction element 22 are held in the container 14 in such a manner to rotate around themselves integrally around their axis 28.

In order to guide the rotation of the first friction element 16, on the internal side of the bottom 18, provided for is an annular central guide rib 26 perfectly fitting onto which is a circular guide hole 27 of mating shape present on the first friction element 16 itself.

In order to guide the rotation of the third friction element 22 provided for is a cylindrical guide sleeve 29, arranged centrally on the internal side of the bottom 18 and coaxially and internally with respect to the annular rib 26, perfectly fitting onto which is an indentation 30 of mating shape made centrally on the face of the third friction element 22 facing the second friction element 19.

The second friction element 19 is held fixed in the container 14 through a central recess 31 of the second friction element 19 which settles into the guide hole 27 of the first friction element 16 and which in turn has a non-circular central hole 32 which perfectly fits onto a central relief 33 of mating shape present on the bottom 18.

The perimeter of the hole 32, in particular, is made up of two oppositely positioned arched sections separated by two rectilinear sections.

Therefore, the central rib 26 circumscribes the central relief 33 which in turn circumscribes the central sleeve 29 on the bottom 18 of the container 14.

The height of the central rib 26 from the bottom 18 is equivalent to the thickness of the first disk 16, the height of the central relief 33 from the bottom is equivalent to the sum of the thickness of the first and second friction element 16 and 19, and the height of the central sleeve 29 from the bottom is comprised between the sum of the thickness of the first and second friction element 16 and 19 and the sum of the thickness of all the other friction elements 16, 19 and 22.

Preferably, the first and second friction element 16 and 19 are made up of a thin metal or plastic or ceramic sheet with surfaces having a high coefficient of friction.

In the structure thus described, the first contact surfaces 17 coincides with circular ring around the hole 27 defined by the side of the first friction element 16 facing the bottom 18, the second contact surface 20 coincides with the circular ring around the hole 27 defined by the side of the first friction element 16 facing the second friction element 19, and the third contact surface 21 coincides with the circular ring around the recess 31 defined by the side of the second friction element 19, facing the third friction element 22.

Furthermore, the container 14 houses a slider 23 moveable along a direction of translation during the rotation of the arm 5 with respect to the box-shaped body 4, and kinematic means for the conversion of the translation of the slider 23 into a rotation of the first and third friction element 16 and 22 in such a manner to create friction due to dragging at the first, second and third friction surface 17, 20 and 21 which causes the deceleration of the rotation of the hinge.

The kinematic conversion means comprise a series of spiral grooves 34 centered on the side of the third friction element 22 facing a cover 35 of the container 14.

The slider 23 is a flexible plate having a drawing element 36 fitted into one of the grooves.

The slider 23 is guided sliding along a guide opening 37 made on the cover 35 and, through an opening 38 of the bottom 15 of the box-shaped body 4, it is accessible for a control cam 39 fixed onto the equaliser 3.

A flattened portion 40 of the slider 23 remains permanently wedged between the bottom 15 of the box-shaped body 4 and the third friction element 22 to ensure the maintenance of a proper sliding position inside the opening 37 of the cover 35.

An opening 41 present on the slider 23 houses the control cam 39 whose movement determines the shifting of the slider 23 itself.

Lastly, the slider 23 has special means for receiving the movement from a first profile 43 of the control cam 39 during the rotation of the hinge in the closing direction, distinguished by special means for receiving the movement from a second profile 45 of the control cam 39 during the rotation of the hinge in the opening direction.

In particular, the opening 41 has a rounded edge 42 for receiving the movement from the first profile 43 of the control cam 39 during the rotation of the hinge in the closing direction, while a pair of pins 44 provided on the slider 23 project into the opening 41 for receiving the movement from a second profile 45 of the control cam 39 during the rotation of the hinge in the opening direction.

The drawing element 36 and groove 34 into which it is fitted have a mating transverse section in form of a saw tooth in such a manner that during the rotation of the hinge in the closing direction their edges 46, 47—orthogonal with respect to the direction of translation of the slider 23—interfere forcing the drawing element 36 to slide in the groove 34 into which it is fitted to set the third friction element 22 (together with the first friction element 16) in rotation, while during the rotation of the hinge in the opening direction their edges 48, 49—tilted with respect to the direction of translation of the slider 23—interfere allowing the drawing element 36 to extend beyond the groove 34 into which it is fitted ending up coupled in the adjacent one exploiting the flexibility of the slider 23 in a manner such not to set the third friction element 22 (together with the first friction element 16) in rotation.

Therefore, basically, during the rotation of the hinge in the closing direction the control cam 39, rotating around the pivot 9, presses against the edge 42 with its profile 43 causing the translation in one direction of the slider 23. In this direction of translation, the drawing member 36 remains in the groove 34 into which it is fitted sliding and drawing in rotation the third friction element 22 and the first friction element 16 integral thereto. The dragging friction generated at the contact surfaces 17, 20 and 21 and between the moving parts (first and third friction element 16 and 22) and the fixed parts (bottom 18 and second friction disk 19) determines the desired deceleration.

On the contrary, during the rotation of the hinge in the opening direction, the control cam 39 rotating around the pivot 9 presses onto the pins 44 with its profile 45 causing the translation in the opposite direction of the slider 23. In this direction of translation, the drawing member 36 extends beyond the groove 34 into which it is fitted fitting into the adjacent one thus drawing in rotation neither the third friction element 22 nor the first friction element 16 integral thereto. The first and the third friction element 16 and 22 remain still and the deceleration effect is not applied.

In order to increase the efficiency of the deceleration device 1 it is possible but not obligatory to fill the container 14 with a viscous medium to obtain the deceleration with a combined viscous/mechanical type of effect.

It should be observed that snap-connection means are also provided for between the container 14 and the cover 35, in particular provided by special extended holes 60 present perimetrally with respect to the external side surface of the container 14 and by snap-teeth 61 of mating shape present perimetrally with respect to the external side surface of the cover 35. Therefore, the deceleration device can be assembled in an autonomous manner.

Lastly, the deceleration device 1 has means for quick coupling to the box-shaped body 4 of the hinge, in particular comprising a U-bolt (not shown) with parallel shanks adapted to engage into special holes 62 and 63 of the box-shaped body 4 and 64, 65 of the cover 35 (alternatively, the holes 64, 65 can be provided for on the container 14). The parallel shanks of the U-bolt advantageously form the pivots 7 and 9 for hinging the equalisers 2 and 3 against the box-shaped body 4. This allows mounting the deceleration device by simply adding a station to the pre-existing assembly line of the hinge which thus does not require modifications.

Abutment means are provided for between the complex formed by the container 14 and by its cover 35 on one side and the box-shaped body 4 of the hinge on the other, ending up mutually arranged at the proper position for their subsequent blocking by means of the U-bolt.

The abutment means comprise at least one pin 66 on the cover fittable into a corresponding hole 67 on the box-shaped body 4 of the hinge.

The deceleration device thus conceived is susceptible to various modifications and variants, all falling within the scope of the inventive concept; furthermore, all details can be replaced by technically equivalent elements.

Figure 10:
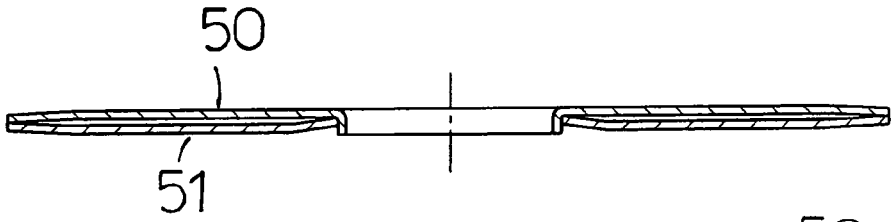
FIG. 10 shows a view in diametral section and a view in side elevation of a second preferred embodiment of the second friction element.

In particular, referring to FIG. 10 the second friction element this time is made up of a pair of cup disks 50 and 51 opposite and elastically pressed against each other between the first and the second friction element. The rotation can be blocked by means of a system similar to the one described for the first preferred embodiment of the second friction element and which thus shall not be described again. This solution allows increasing the adherence of the second friction element with the first and the third friction element at the second and third friction surface.

Figure 11:
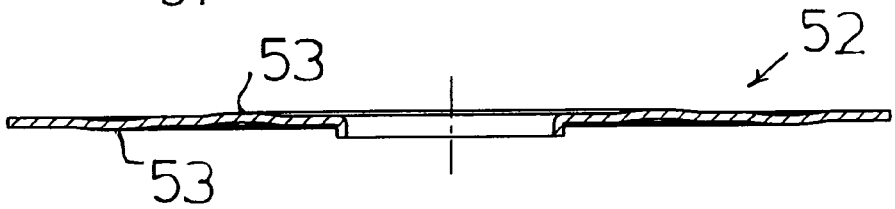
FIG. 11 shows a view in diametral section and a view in side elevation of a third preferred embodiment of the second friction element.

Referring to FIG. 11 the second friction element this time is made up of a single circular fixed disk 52 whose surface has corrugations 53 which create an elastic effect analogous to the one described above and serving the same purpose. Also in this case, the rotation is blocked by means of a system similar to the one described for the first preferred embodiment of the second friction element.

Figure 12:
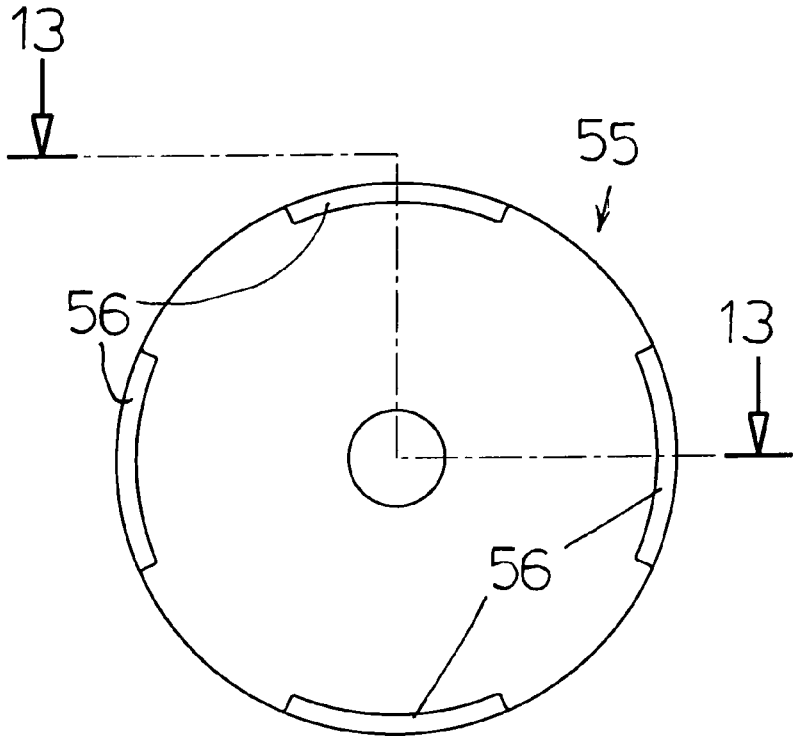
FIG. 12 shows a bottom plan view of a second preferred embodiment of the third friction element.
Figure 13:
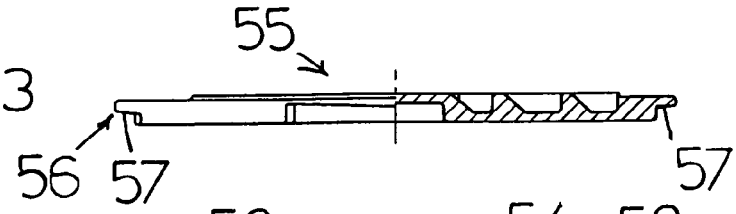
FIG. 13 shows a side elevated view of the third friction element of FIG. 12 sectioned according to line 13-13.
Figure 14:
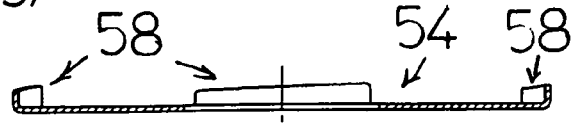
FIG. 14 shows a view in diametral section and a view in side elevation of a second preferred embodiment of the first friction element associable with the third friction element of FIG. 12.

Referring to FIGS. 12, 13 and 14 the first and the third friction element 54 and 55 differ from the ones illustrated previously only due to the different embodiment of the constraint means. In this case, the constraint means comprise support seats 56 having a tilted edge 57 and projections 58 of mating shape adapted to lie against them. The seats 56 are provided for perimetrally on the third friction element 55 while the projections 58 are provided for perimetrally on the first friction element 54, and their arrangement on the third and first disk can obviously be inverted. The perimeter length of the projections 58 is smaller than the perimeter length of the seats 56 in order to allow their relative slight rotation which, in the closing rotation direction of the hinge, triggers a wedge effect and exerts a greater pressure between the first friction element 54 and the bottom 18.

In practice, the materials used, as well as the dimensions, may vary depending on the requirements and the state of art.

The invention is:

1. A device for deceleration of at least closing rotation of a furniture hinge, comprising a container, the container housing:

a first rotating friction element having a first friction surface contacting with the bottom of the container, a second fixed friction element overlapping the first rotating friction element and having a second friction surface contacting with the first rotating friction element, and at least one third rotating friction element overlapping the second fixed friction element and having a third friction surface contacting with the second fixed friction element, a constraint device between the first friction element and the third friction element, wherein the first friction element and the third element rotate in the same direction, a slider moveable along a direction of translation at least during the closing rotation, and a kinematic device for conversion of the translation of the slider into rotation of the first and the third friction element in such a manner as to create a dragging friction at the first, second and third friction surface.

2. The deceleration device according to claim 1, wherein the first, second and third friction elements each comprise at least one circular disk, and the elements are stacked coaxially with their axis arranged in coincidence with the axis of a hollow cylindrical body of the container.

3. The deceleration device according to claim 1, wherein the first, second and third friction elements each comprise a single flat circular disk.

4. The deceleration device according to claim 1, wherein the constraint device comprises perimeter flaps of the first friction element engaged into perimeter slots of mating shape of the third friction element.

5. The deceleration device according to claim 1, wherein, in order to guide the rotation of the first friction element, on the internal side of the bottom of the container, provided for is an annular central guide rib perfectly fitting onto which is a circular central guide hole of mating shape present on the first friction element.

6. The deceleration device according to claim 5, wherein, in order to guide the rotation of the third friction element, provided for is a cylindrical guide sleeve, arranged centrally on the internal side of the bottom and coaxially and internally with respect to the annular rib, perfectly fitting onto which is an indentation of mating shape made centrally on the face of the third friction element facing the second friction element.

7. The deceleration device according to claim 6, wherein the second friction element is held fixed by means of a central recess of the second friction element which is arranged in the guide hole of the first friction element and which in turn has a non-circular central hole which perfectly fits onto a central relief of mating shape present on the bottom.

8. The deceleration device according to claim 1, wherein the first and second friction elements are made up of a thin sheet with surfaces having a high coefficient of friction.

9. The deceleration device according to claim 1, wherein the kinematic conversion devide comprises a series of spiral grooves centered on a side of the third friction element facing a cover of the container.

10. The deceleration device according to claim 9, wherein the slider is a flexible plate having a drawing element fitted into one of the grooves, the slider being guided sliding along a guide opening made on the cover of the container.

11. The deceleration device according to claim 10, wherein the slider has an opening having means for receiving the movement during the rotation in the hinge closing direction, distinguished by means for receiving the movement during the rotation in the hinge opening direction.

12. The deceleration device according to claim 11, wherein the grooves and the drawing element have mating transverse sections in the form of a saw-tooth.

13. The deceleration device according to claim 1, wherein the container is filled with a viscous medium to obtain deceleration with a combined mechanical and viscous effect.

14. The deceleration device according to claim 1, wherein the second friction element comprises a pair of cup disks opposite and elastically pressed against each other between the first and the second friction element.

15. The deceleration device according to claim 1, wherein the second friction element comprises a circular disk whose surface has corrugations which create an elastic effect between the first and second friction elements.

16. The deceleration device according to claim 1, wherein the constraint device comprises support seats having a tilted edge and projections of mating shape adapted to lie against them, the seats being provided for perimetrally on the third friction element and the projections being provided for perimetrally on the first friction element or vice-versa.

17. The deceleration device according to claim 16, wherein perimeter length of the projections is smaller than the perimeter length of the seats to allow their relative slight rotation which, in the hinge closing rotation direction, triggers a wedge effect and increases the pressure between the first friction element and the bottom.

18. The deceleration device according to claim 17, comprising connectors for snap-connection between the container and the cover.

19. A furniture hinge having a first and a second equalizer, which operatively connect between them a box-shaped body constructed to be fixed onto a furniture door, and an arm constructed to be fixed onto a fixed furniture element, the hinge comprising a deceleration device according to claim 1, fixed on the external side of the bottom of the box-shaped body.

20. The furniture hinge according to claim 19, comprising a coupling device for quick coupling of the deceleration device to the box-shaped body.

21. The furniture hinge according to claim 20, wherein the quick coupling device comprises a U-bolt having parallel shanks engaged into special holes of the box-shaped body and of the container or of the cover.

22. The furniture hinge according to claim 21, wherein the shanks form pivots for hinging the equalizer against the box-shaped body.

23. The furniture hinge according to claim 22, wherein the bottom of the box-shaped body has an opening from which a control cam fixed onto one of the equalizers accesses to means for receiving the movement during rotation in the hinge closing direction, and to distinguished means for receiving movement during the rotation in the hinge opening direction, for their movement.

24. The deceleration device according to claim 1, wherein the constraint device comprises perimeter flaps, and the perimeter flaps of the third friction element are engaged into perimeter slots of mating shape of the first friction element.

* * * * *

UNITED STATES PATENT AND TRADEMARK OFFICE

CERTIFICATE OF CORRECTION

PATENT NO. : 8,091,176 B2
APPLICATION NO. : 12/521978
DATED : January 10, 2012
INVENTOR(S) : Luciano Salice It is certified that error appears in the above-identified patent and that said Letters Patent is hereby corrected as shown below:

In the Claims

Claim 1 - Col. 6; Ln 37, delete “moveable” and insert --movable--, therefor.

Claim 9 - Col. 7; Ln 11, delete “devide” and insert --device--, therefor.

Claim 17 - Col. 8; Ln 7, after “increases” delete “the”.

Claim 23 - Col. 8; Ln 32, after “receiving” delete “the”.

Signed and Sealed this
Twenty-fourth Day of March, 2015

Michelle K. Lee

Michelle K. Lee
*Director of the United States Patent and Trademark Office*